US005853823A

United States Patent [19]

McKenna

[11] Patent Number: 5,853,823

[45] Date of Patent: Dec. 29, 1998

[54] SPORTS AWARD PLURAL COMPONENT DISPENSER DEVICE

[76] Inventor: Paul A. McKenna, Ocean Crest, 14 Washington Rd. Suite 312, Princeton Junction, N.J. 08550

[21] Appl. No.: 801,901

[22] Filed: Feb. 14, 1997

Related U.S. Application Data

[63] Continuation-in-part of Ser. No. 657,280, Jun. 4, 1996.

[51] Int. Cl.[6] ..... A47G 7/00

[52] U.S. Cl. ..... 428/7; 428/24; 428/27; 428/542.4

[58] Field of Search ..... 428/7, 542.4, 24, 428/27

[56] References Cited

U.S. PATENT DOCUMENTS

| | | | |
|---|---|---|---|
| D. 258,125 | 2/1981 | Bailey | D11/157 |
| D. 290,632 | 6/1987 | Dehnert | D21/205 |
| D. 293,220 | 12/1987 | Pierce | 428/542.4 X |
| D. 324,780 | 3/1992 | Sebesta | D6/303 |
| 1,141,317 | 6/1915 | Correa | 428/11 X |
| 2,551,354 | 5/1951 | Wasilevich | 428/11 X |
| 3,341,956 | 9/1967 | Marino | 428/542.4 X |
| 3,473,247 | 10/1969 | La Favor et al. | 428/11 X |
| 4,454,204 | 6/1984 | Posey | 428/542.4 |
| 4,493,862 | 1/1985 | Albert et al. | 428/10 |
| 4,888,251 | 12/1989 | Nakada | 428/542.4 |
| 5,277,949 | 1/1994 | Green | 428/13 |
| 5,424,137 | 6/1995 | Stagl | 428/542.4 |
| 5,645,168 | 7/1997 | Honitawa | 428/542.4 X |

*Primary Examiner*—Henry F. Epstein
*Attorney, Agent, or Firm*—Kenneth P. Glynn, Esq.

[57] ABSTRACT

The present invention award plural component dispenser device includes a support means for supporting a framework of an object and a plurality of insert pieces. The support means has a base and a plurality of holders for holding the plurality of insert pieces. Each insert piece is sized and shaped to be removably inserted into a corresponding holder. The insert pieces and holders are polygonally shaped and approximately conical.

18 Claims, 4 Drawing Sheets

SPORTS AWARD PLURAL COMPONENT DISPENSER DEVICE

REFERENCE TO RELATED APPLICATION

This application is a Continuation-in-Part of currently pending U.S. patent application Ser. No. 08/657,280, filed on Jun. 4, 1996 and entitled "Sports Award Plural Component Server Device" by the inventor herein.

BACKGROUND OF THE INVENTION

1. Field of the Invention

The present invention involves a framework formed from a plurality of holders and a plurality of inserts, which form the shape and configuration of a sports object, a gift dispenser or display piece. More particularly, each insert may be a storage container which is inserted into a corresponding holder in an interior of the framework and may house awards, such as medals, certificates, ribbons, trophies and gifts. Each insert may also be a display piece, such as a trophy or a floral arrangement.

2. Information Disclosure Statement

The combination of a framework with inserts having a polygonal approximately conical shape, for holding awards has not been taught by the prior art. There are many design patents which are in the shape of a sports object. However, none of these involve the use of removable insert pieces having polygonal shapes.

In addition, there are patents which describe and illustrate sports objects as part of the devices. Some of them have medallion holders but they do not have a multiplicity of insert pieces having polygonal shapes and the overall design is different from the present invention.

U.S. Pat. No. Des 258,125 to Bailey shows the design of a football trophy and U.S. Pat. No. Des 290,632 to Dehnert et al. shows an ornamental design for a soccer ball. While the present invention may have these designs, these patents do not have insert pieces.

U.S. Pat. No. Des 324,780 to Sebesta discloses a design for a combined picture frame and golf ball rack. Golf balls may be placed in cut-out portions on the lower front portion of the picture frame.

U.S. Pat. No. 5,424,137 to Stagl describes and illustrates a sportsball and medallion holder. The medallion holder includes a mounting having an outer surface whereon a medallion is fastened, and a plate for engaging a spherical sportsball.

U.S. Pat. No. 5,277,949 to Green discloses a frame with glass on both sides for athletic miniatures and sports memorabilia having a double-sided frame made of wooden material with glass members on both sides, and a stiffening board for supporting an athletic miniature or sports memorabilia assembled between the glass members, so that the athletic miniature or sports memorabilia can be viewed through the glass members from both sides of the frame.

U.S. Pat. No. 4,493,862 to Albert et al. discloses an ornamental assembly including a supporting core and a plurality of radially extending decorative elements. Each decorative element has an attachment end securable to the core and a decorative end supported a fixed distance from the core. The core includes a sufficient number of decorative elements of such dimensions as to produce a substantially round ornamental assembly having a central core which is concealed by a uniformly-radially-extended surface comprising the decorative ends of the decorative elements.

U.S. Pat. No. 4,454,204 to Posey discloses a combined bank for coins and noisemaker. The body portion may be shaped to resemble a football or other game ball.

U.S. Pat. No. 3,473,247 to LaFavor et al. discloses a display device for sportsmen having a golf tee on which is mounted a replica of a golf ball having the numeral "1" predominantly displayed thereon, and a round cavity or hole in close visual proximity to the numeral "1" to designate a golfer's "hole in one".

U.S. Pat. No. 2,551,354 to Wasilevich discloses a display device for an autographed trophy exemplified by a baseball which includes a hollow transparent sphere in which the trophy is tightly encased and a supporting base unit for the sphere upon which the sphere is sustained for free rotation. The supporting base unit comprises a cuplike lower portion for retaining the sphere in position therein while at the same time permitting free rotation of the sphere.

U.S. Pat. No. 1,141,317 to Correa discloses a display and ornamentation includes a main support having a plurality of spring clips for holding articles to be displayed. The arms of each spring clip are of substantially lesser length than the diameter of the article displayed and practically hidden thereby. The main support is substantially of the same contour as the article displayed, whereby there is produced a design display of the individual articles as an ornamental whole in the form of an enlarged imitation of the individual articles displayed.

Notwithstanding the prior art, the combination of a sports object framework with insert pieces as taught by the present invention is neither taught nor rendered obvious thereby.

SUMMARY OF THE INVENTION

The present invention sports award plural component dispenser device includes a support means for supporting a framework of an object, such as a sports object, a gift dispenser or a display piece, and a plurality of insert pieces. The support means has a base and a plurality of holders for holding the plurality of insert pieces. Each holder and insert piece is an approximately conical polygonally shape. Each insert piece is sized and shaped to be removably inserted into a corresponding holder.

In another embodiment, the device includes an object with a framework formed from a support means and inserted insert pieces which rests upon a stand. The stand has a base and an object holder attached to the base.

In still yet another embodiment, a common theme is evident in both the individual insert pieces and the entire plural component dispenser device.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

The present invention entails a plural component dispenser device. The device or a portion thereof is formed in the shape and configuration of a sports object, such as a football, half of a soccer ball, an entire soccer ball, a baseball and the like, or an award dispenser or a display piece such as a trophy or floral arrangement.

The device includes a plurality of holders near the center of the framework and a plurality of correspondingly matched insert pieces which may be inserted into the holders. Each holder is approximately conical shaped with an aperture at a base of the holder through which a tip of the insert piece is inserted, thereby causing the insert piece to remain in place, once inserted. The insert pieces have a base portion sized and shaped to extend into an interior of the holders and are also conical-shaped. The holders and insert pieces can be made in various matched polygonal-shaped configurations.

The insert pieces may be in the form of containers, trophies, flower arrangements or the like. If the form is a container, the insert pieces are sized and shaped to hold awards, such as medals, certificates, ribbons, trophies, gifts and the like.

Each insert piece has an optional cover. A plurality of covers is designed so as to resemble the design of the sports object, such as a soccer ball, a football, a baseball and the like.

In one embodiment, half of a framework rests upon a base. The base is sized and shaped to be placed on a table or other solid surface.

In another embodiment, a sports object including a plurality of insert pieces in the shape of trophies rests upon a sports object holder which is connected to a base. In general, each insert piece depicts a theme of an individual symbol by forming a trophy, a floral arrangement, a geometric design, various sized containers and the like.

When viewed as a whole i.e., when the plurality of insert pieces are inserted into the plurality of corresponding holders and connected to the object holder which is connected to the base, an overall them is formed which is approximately similar to the theme formed by the individual insert pieces. Thus, it follows that the totality of the individual components forms a device having created characteristics which are also included in the individual components.

Figure 1:
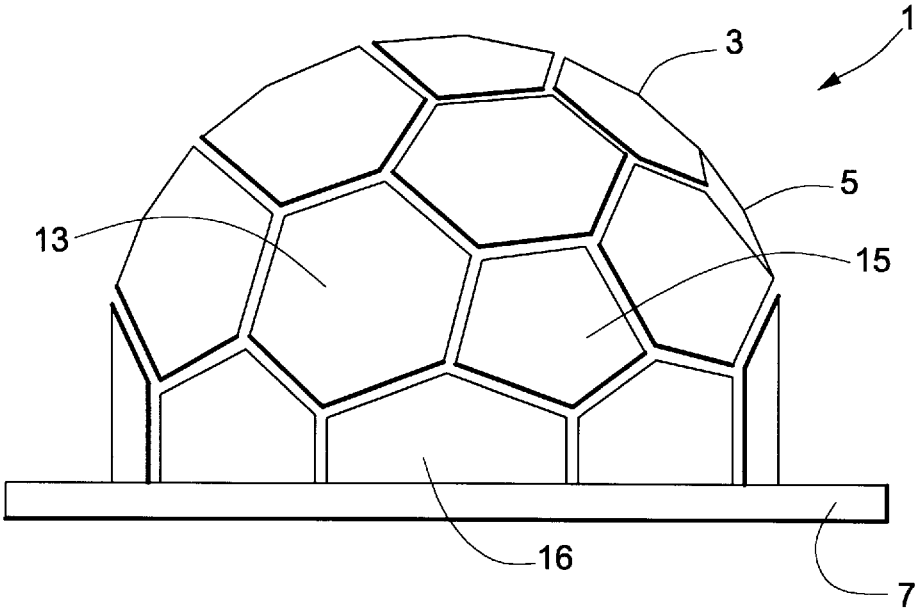
FIG. 1 shows a front view of a plural component dispenser device and FIG. 2 shows a perspective view of the device shown in FIG. 1, but having some insert pieces removed.
Figure 2:
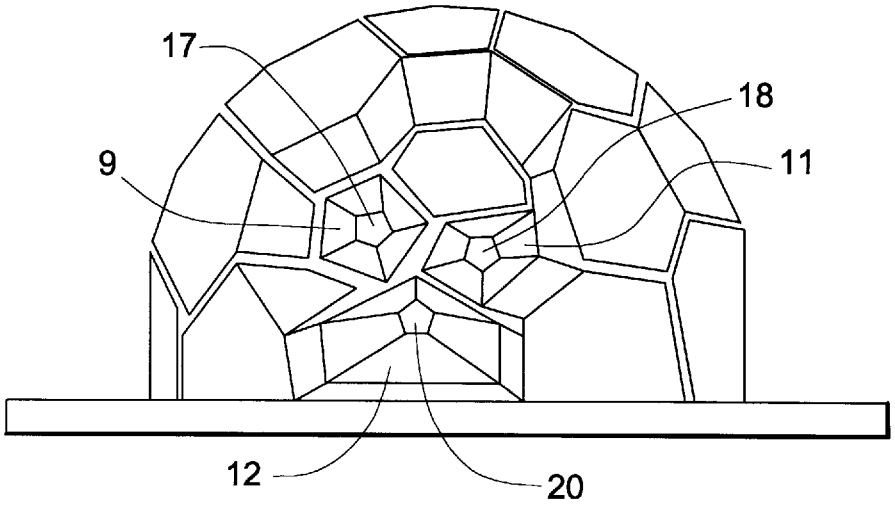

Referring now to FIGS. 1 and 2, there is shown one embodiment of a present invention plural component dispenser device 1. The plural component dispenser device 1 includes a support means 3 for supporting a framework of an object 5, such as a sports object, a gift dispenser or display piece. The support means 3 includes a base 7 and a plurality of holders 9, 11, 12 which house a plurality of insert pieces 13, 15, 16.

Each holder 9, 11, 12 has an aperture 17, 18, 20 for passing an insert piece 13, 15, 16 therethrough, which causes the insert pieces 13, 15, 16 to remain intact once inserted. The holders 9, 11, 12 are polygonally shaped and are matched to insert pieces 13, 15, 16 which have at least a portion thereof correspondingly polygonally shaped. The holders 11, 12 are hexagonally shaped and form an approximate cone having apertures 18, 20 on a tip of the holders 11, 12. The holder 9 is six-sided and also has an aperture 17 on a tip of the holder 9.

The plurality of insert pieces 13, 15, 16 are removably inserted into the plurality of holders 9, 11, 12. In this embodiment, the insert pieces 13, 15, 16 are storage containers sized and shaped so as to hold an award such as a ribbon, a medal, a certificate, a trophy and the like. The plurality of insert pieces 13, 15, 16 when inserted into the support means 3 form a shape of the object 5, in this case, a semicircular shaped soccer ball.

Figure 3:
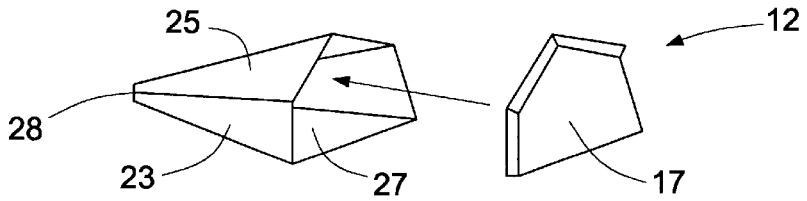
FIG. 3 shows a perspective view of a hexagonal insert piece shown in FIG. 1.

Referring now to FIG. 3, there is shown insert piece 16 which is hexagonally shaped forming an approximate cone. Insert piece 16 has an optional cover 17, five sidewalls (two of which are shown) 23, 25, forming the shape of a hexagon and a tip 28. The interior 27 of the insert piece 16 is hollow so that it can hold an award, medal, gift or the like.

The cover 17 has a connection means for removably connecting the cover 17 to the front of the insert piece 16. The connecting means may be a force fit of the cover 17 into the insert piece 16.

Figure 4:
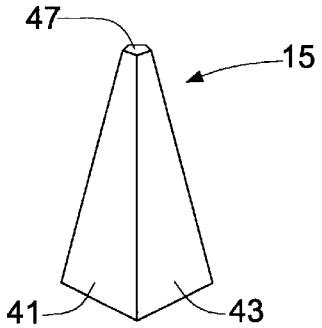
FIGS. 4 and 5 show a side view and a front view, respectively, of another hexagonal insert piece shown in FIG. 1.
Figure 5:
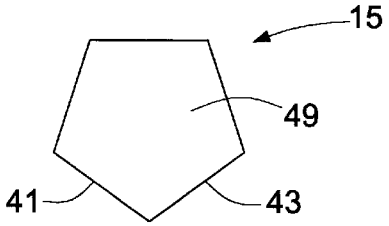

Referring to FIGS. 4 and 5, there is shown a side and front view of insert piece 15. The insert piece 15 includes a front 49 and five sidewalls (two of which are shown) 41, 43 and a tip having an aperture 47.

Figure 6:
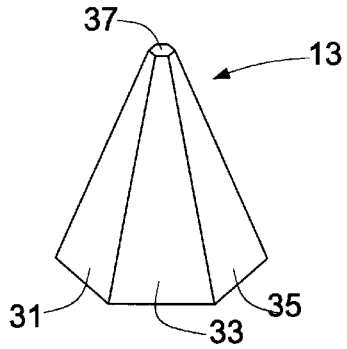
FIGS. 6 and 7 show a side view and a front view, respectively, of a six-sided insert piece shown in FIG. 1.
Figure 7:
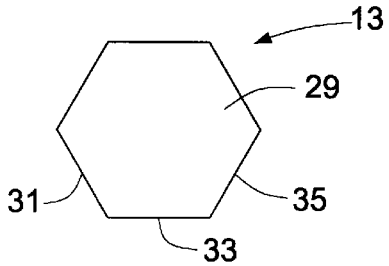

Referring to FIGS. 6 and 7, there is shown a side and front view of insert piece 13. The insert piece 13 includes a front 29 and six sidewalls (three of which are shown) 31, 33, 35 and a tip having an aperture 37. In this case, the front 29 is integrally formed with the sidewalls, 31, 33, 35.

Figure 8:
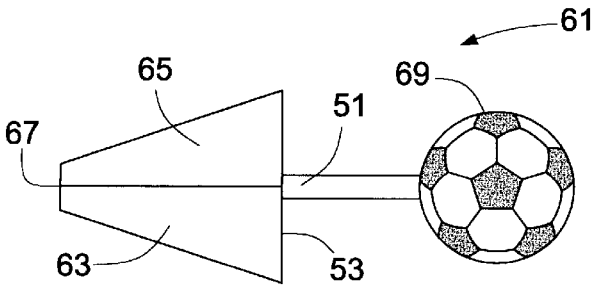
FIG. 8 shows an alternate embodiment of an insert piece which forms a trophy.

Referring to FIG. 8, there is shown an alternative embodiment of a present invention insert piece 61. The insert piece 61, which is hexagonally shaped in an approximate cone, includes five sidewalls (two of which are shown) 63, 65, a tip 67, and a trophy image, in this case, a soccer trophy with a soccer ball 69 located on a top of the insert piece 61 and attached to a support 51 which is attached to a solid base 53 on the insert piece 61. The trophy image may be in various designs and configurations. The approximate cone extends from the solid base 53 to the tip 67 of the insert piece 61.

Figure 9:
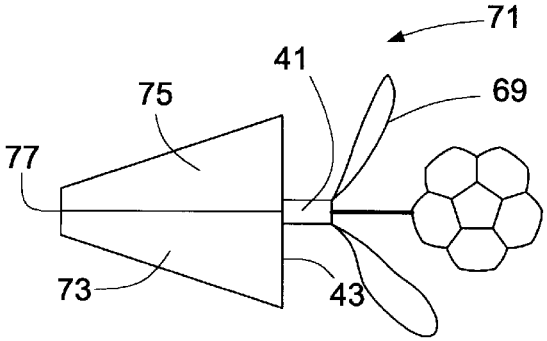
FIG. 9 shows an alternate embodiment of an insert piece which forms a floral arrangement.

Referring now to FIG. 9, there is shown another alternative embodiment of a present invention insert piece 61. The insert piece 71, which is hexagonally shaped in an approximate cone, includes five sidewalls (two of which are shown) 73, 75, a tip 77, and a floral arrangement 69 attached to a support 41 which is attached to a solid base 43 on the insert piece 71. The floral arrangement may be in various designs and configurations. The approximate cone extends from the solid base 43 to the tip 77 of the insert piece 71.

Figure 10:
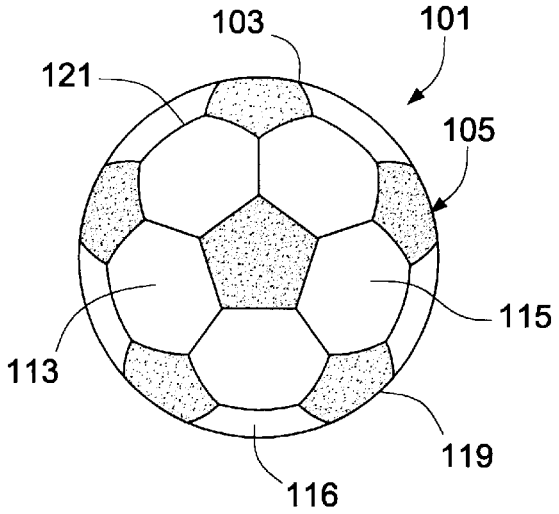
FIG. 10 shows a front view of another embodiment of a plural component dispenser device having a wire framework.

Referring to FIG. 10, there is shown a front view of an alternate embodiment present invention device 101. Similar parts to those shown in FIGS. 1 and 2 are similarly numbered but incremented by 100.

In this embodiment, the object 105 is circular-shaped and resembles a soccerball. A support means 103 also includes a frame 121 which outlines the design of the object 105. The frame 121 may be made from wire, a plastic or the like and outlines a perimeter of a front of an insert piece 113, 115, 116.

Figure 11:
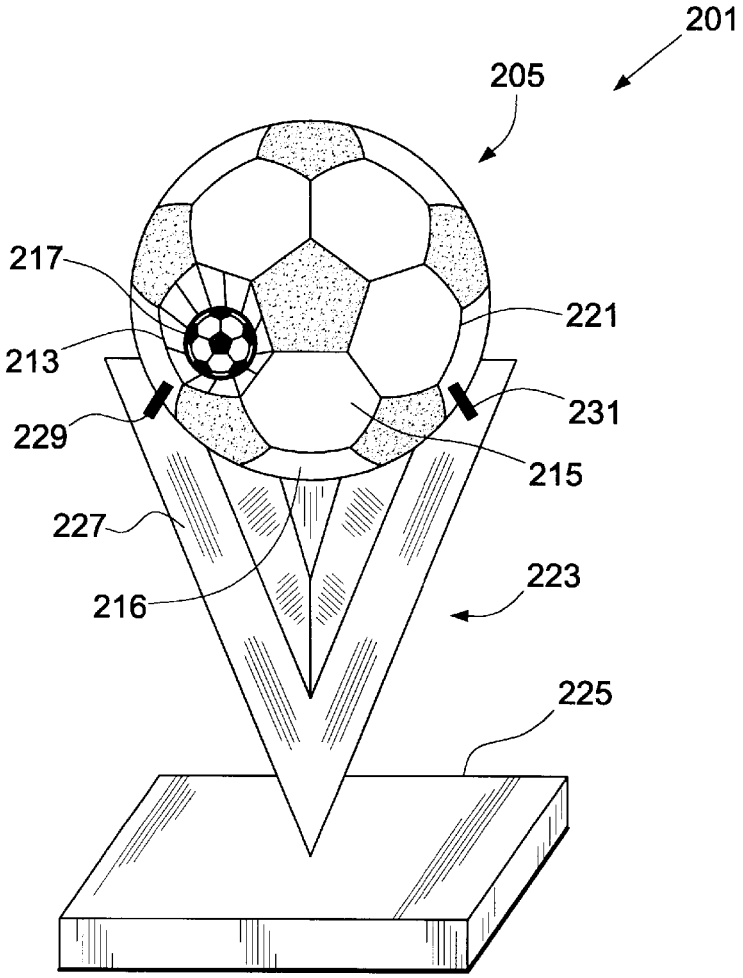
FIG. 11 shows a front, perspective view of another embodiment of a plural component dispenser device including a stand.

FIG. 11 shows still yet another embodiment of a present invention plural component dispenser device 201, in this case a trophy. Similar parts are numbered as in FIGS. 1 and 2 but incremented by 200.

The trophy 201 includes a stand 223 having a base 225 and an object holder 227 attached to the base 225. The object holder 227 is sized and shaped to hold an object 205 formed from a plurality of holders (not shown) and a plurality of insert pieces 213, 215, 216 having either an integrally formed cover or a removeably connected cover. Since the insert piece 213 is shown with a cover removed, a top of a trophy 217 is shown within the insert piece 213.

The trophy 217 represents a theme of an award symbol. In addition, the trophy device 201 also represents a theme of an award symbol. The two themes have essentially the same characteristics with the distinction that the unit trophy 217 may be an individual award symbol while the trophy device 217 may be a group award symbol. The sum of a plurality of unit designs, i.e. the plurality of insert pieces 213, 215, 216 when inserted into the corresponding plurality of holders on the trophy 201 include a unit theme of individual award symbols, as well as an overall theme of group award symbols. Thus, when viewed as a whole, the trophy device 201 encompasses more than its individual components, i.e. the individual award symbols.

The object holder 227 may be V-shaped and includes a holding means, in this case clamps 229, 231 for holding the object 205 in place. The holding means may also be cutouts in the object holder 227, ledges in the object holder 227, an adhesive material and the like.

Figure 12:
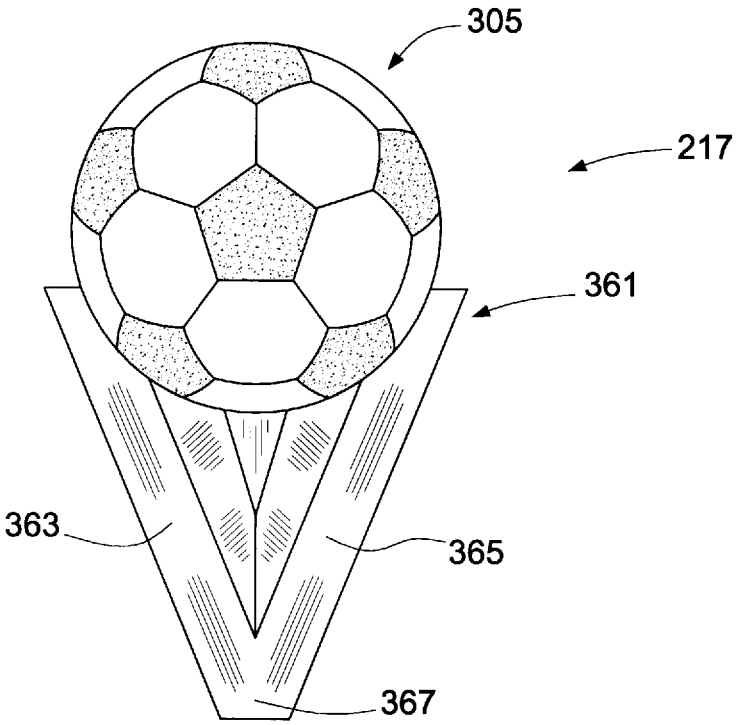
FIG. 12 shows a front, perspective view of an insert piece shown in FIG. 11 which is a trophy.

Referring now to FIG. 12, there is shown the trophy 217, which is an insert piece shown in FIG. 11. The insert piece 217 includes a top 305 and a base 361 having a plurality of sidewalls 363, 365, in this case exactly two, and a tip 367. The base 361 includes connecting means for connecting the top 305 to the base 361 and is adapted to be inserted into a corresponding holder (not shown). The tip 367 is adapted to permit the trophy 217 to rest on a surface and/or a stand.

The top 305 of the insert piece, i.e. trophy 217 is in the form of a soccer ball. However, it could be any other sports object, a floral arrangement, a geometric design, a container, a gift dispenser and the like.

Obviously, numerous modifications and variations of the present invention are possible in light of the above teachings. For example, the shape of the correspondingly matched holders and insert pieces may be other than hexagonal or six-sided. The insert pieces may be other designs than a trophy, such as a floral arrangement, a container, a geometric shape or the like. The geometric shape may be polygonal, triangular, convex, concave, a solid and the like. The theme may be an award symbol, a floral arrangement, a gift dispenser, individual shapes and the like. It is therefore understood that within the scope of the appended claims, the invention may be practiced otherwise than as specifically described herein.

What is claimed is:

1. A plural component dispenser device, which comprises:

(a) support means for supporting a framework of an object, said support means having a base and a plurality of adjacent hollow holders for holding a plurality of separate, removable insert pieces, each holder being connected to its adjacent holders and having a polygonal shaped cross-section and a generally conically-shaped length;

(b) a plurality of separate, removable insert pieces, each insert piece sized and shaped to be removably inserted into a corresponding said holder; and, (c) a plurality of covers openably connected to each of said plurality of insert pieces.

2. The device of claim 1 wherein said device forms a sports object.

3. The device of claim 2 wherein said insert piece is a trophy.

4. The device of claim 2 wherein said insert piece is a container.

5. The device of claim 4 wherein said support means is semi-circular shaped.

6. The device of claim 5 wherein said support means further includes a wire frame, said wire frame outlining the perimeter of a front of said plurality of said insert pieces.

7. The device of claim 1 wherein said insert piece is a floral arrangement.

8. The device of claim 1 wherein each of said insert piece includes a cover connected to said front of said insert piece.

9. The device of claim 1 wherein said polygonal shape is hexagonal.

10. The device of claim 1 wherein each said holder includes an aperture on a tip of said holder.

11. A plural component dispenser device, which comprises:

(a) support means for supporting a framework of an object, said support means having a base and a plurality of adjacent hollow holders for holding a plurality of separate, removable insert pieces, each holder being connected to its adjacent holders and having a polygonal shaped cross-section and a generally conically-shaped length;

(b) a plurality of separate, removable insert pieces, each insert piece sized and shaped to be removably inserted into a corresponding said holder;

(c) a plurality of covers openably connected to each of said plurality of insert pieces; and, (d) a stand adapted to hold said support means and said plurality of insert pieces.

12. The device of claim 11 wherein said support means with said plurality of said insert pieces inserted therein, forms a sports object.

13. The device of claim 12 wherein said insert piece is a trophy.

14. The device of claim 11 wherein said insert piece is a floral arrangement.

15. A plural component dispenser device, which comprises:

(a) support means for supporting a framework of an object, said support means having a base and a plurality of adjacent hollow holders for holding a plurality of separate, removable insert pieces, each holder being connected to its adjacent holders and having a polygonal shaped cross-section and a generally conically-shaped length;

(b) a plurality of separate, removable insert pieces, each insert piece sized and shaped to be removably inserted into a corresponding said holder;

(c) a plurality of covers openably connected to each of said plurality of insert pieces; and, (d) a stand adapted to hold said support means and said plurality of insert pieces, such that when said plurality of said insert pieces are inserted into said plurality of said corresponding holders on said device, a plurality of themes is formed, said plurality of said themes having an overall theme wherein said overall theme is near similar to said unit theme.

16. The device of claim 15 wherein said unit theme and said overall theme is an award symbol.

17. The device of claim 16 wherein said award symbol is a trophy.

18. The device of claim 15 wherein said unit theme and said overall theme is a floral arrangement.

* * * * *